United States Patent [19]

Kameya

[11] Patent Number: 5,049,707

[45] Date of Patent: Sep. 17, 1991

[54] SUPER HIGH FREQUENCY SWITCHING DEVICE

[75] Inventor: Kazuo Kameya, Tokyo, Japan

[73] Assignee: Elmec Corporation, Kawasaki, Japan

[21] Appl. No.: 567,631

[22] Filed: Aug. 15, 1990

[30] Foreign Application Priority Data

Aug. 30, 1989 [JP] Japan ..... 1-223721

[51] Int. Cl.[5] ..... H01H 15/00

[52] U.S. Cl. ..... 200/16 D; 200/305

[58] Field of Search ..... 200/16 R, 16 B, 16 C, 200/16 D, 292, 304, 305, 504; 333/101, 105; 174/52.1

[56] References Cited

U.S. PATENT DOCUMENTS 4,052,573 10/1977 Kojima et al. ..... 200/16 D X
4,185,176 1/1980 Matsuo ..... 200/16 D
4,507,627 3/1985 Ito et al. ..... 200/305

*Primary Examiner*—J. R. Scott
*Attorney, Agent, or Firm*—Fish & Richardson

[57] ABSTRACT

A switching device for super high frequency ranges comprising a common fixed contact and a pair of selectable fixed contacts, and moveble contacts which are slidable over them so as to selectively and electrically connect the common fixed contact to one of the selectable fixed contacts. A pair of buffer electrodes are placed between the common fixed contact and the selectable fixed contacts to reduce the electrostatic capacitance between the fixed contacts and reduce signal attenuation in super high frequency ranges. The buffer electrodes are electrically isolated without being connected to any external circuit and thereby reduce electrical capacitance produced between the common fixed contact and the selectable fixed contacts without creating excessive gaps therebetween. Such gaps would prevent smooth sliding movement of the moveable contacts. To promote smooth sliding moveable of the moveable contacts, the buffer contact may have the shape of a chevron while the corresponding edges of the fixed contacts are provided with complementary concave and convex shapes so as to minimize the maximum width of the gaps therebetween. Optionally, each of the buffer electrodes may be provided with slits extending in the direction of the movement of the movable contacts to further reduce the electrostatic capacitance between the fixed contacts. This switching device is suitable for use in switching over delay lines in a digital variable delay line.

7 Claims, 4 Drawing Sheets

SUPER HIGH FREQUENCY SWITCHING DEVICE

TECHNICAL FIELD

The present invention relates to a super high frequency switching device, and in particular to a super high frequency switching device which can be manually switched over with proper impedance matching over a wide frequency range including the GHz band.

BACKGROUND OF THE INVENTION

Conventionally, switching devices for switching over super high frequency range signals in the GHz band typically included diodes serving as electronic switching devices. Such devices utilize the property of the diode to function as a switch depending on the way DC current is conducted through the diode. As other similar devices, there are switching devices which make use of slide switches, reed relays and other mechanical switching elements.

However, such switching devices using diodes create a substantial loss by their introduction into super high frequency electric circuits, and particularly when a plurality of such devices are connected in series the overall signal loss is so great that the use of such switching devices is not practical.

Also, slide switches are not suitable for switching over signals while maintaining impedance matching of an impedance line, and such a mismatching is typically so large even in frequencies in the order of 100 MHz that they are practically unusable in super high frequency ranges.

Reed relays can be used in super high frequency bands depending on their structure, but special considerations are required for connecting them with external circuits, and they tend to be large in size and expensive to manufacture.

To eliminate such problems of the prior art, the inventor proposed a new super high frequency switching device in Japanese patent application No. 63-234289.

According to this proposal, a ground electrode is formed on one side of a dielectric layer, and common fixed contacts are formed on the opposite side of the dielectric layer. The common fixed contacts are each interposed by a pair of selectable fixed contacts on either side, and a shield electrode is placed between each opposing pair of a selectable fixed contact and a common fixed contact. W-shaped moveable contact springs each having a pair of legs adapted to slide over an associated one of the common fixed contacts and one of the associated selectable contacts, respectively, are received in a spring holder which is slidably supported above the common fixed contacts and the selectable fixed contacts.

However, according to this structure, because the shield electrodes are located between the selectable fixed contacts and the common fixed contacts, the moveable contacts springs are grounded temporarily during their sliding movement. Therefore, if the moveable contact springs are connected to ECL or other external circuits including ICs, the ICs could be destroyed in some cases, and it is therefore necessary to take special measures such as effectively grounding the shield electrodes via capacitors for high frequency current.

Such a super high frequency switching device is typically used in a variable delay line for switching over super high frequency signals, and the frequency range of the delay line must cover a wide range extending from DC to super high frequency ranges. It is therefore necessary to set the resonant frequency as determined by the inductance of the shield electrodes and the capacitance of the capacitors higher than the frequency range of the delay line. Therefore, the circuit design is made highly complex, and the control of the resonant frequency requires special considerations because the capacitance of such capacitors can vary over a certain range. These factors increase the cost of the switching device.

It is conceivable to eliminate the shield electrodes. It is then necessary to reduce the spacing between the common fixed contacts and the selectable fixed contacts so that the moveable contacts can slide over them in a smooth manner without dropping into the gaps therebetween. When the spacing is reduced to a certain extent, a considerable electrostatic capacitance is formed therebetween, and will cause signal cross-talks.

BRIEF SUMMARY OF THE INVENTION

In view of such problems of the prior art, a primary object of the present invention is to provide a super high frequency switching device which is compact and economical, and can switch over signals over a wide frequency range extending from a low frequency range to the GHz frequency range while maintaining a favorable impedance matching throughout this frequency range.

A second object of the present invention is to provide a super high frequency switching device which is free from signal cross-talks.

A third object of the present invention is to provide a super high frequency switching device which can be directly connected to external circuits without requiring any special considerations.

These and other objects of the present invention can be accomplished by providing a super high frequency switching device, comprising: a dielectric layer having first and second major surfaces opposing each other; a ground electrode formed on the first major surface; a common fixed contact formed on the second major surface; a pair of selectable fixed contacts formed on the second major surface on either side of the common fixed contact; a pair of buffer electrodes formed in gaps defined between the common fixed contact and the selectable fixed contacts; an insulated moveable contact holder slidably supported over the common fixed contact and the selectable fixed contacts; and moveable contacts carried by the moveable contact holder for sliding contact with the common fixed contact and the selectable fixed contacts between a first position to electrically connect the common fixed contact with one of the selectable fixed contacts and a second position to electrically connect the common fixed contact with the other of the selectable fixed contacts.

Thus, according to the present invention, the common fixed contact and the selectable fixed contacts form a micro strip line having a certain characteristic impedance by opposing the ground electrode across the dielectric layer. Also, the electrostatic capacitance between the fixed contacts is reduced while a certain electrostatic capacitance is created between the buffer electrodes and the ground electrode. These two factors in the parasitic capacitance of the switching device contribute to the reduction in signal leakage between the fixed contacts.

According to a preferred embodiment of the present invention, there is provided an electroconductive holder guide electrically connected to the ground terminal and placed above the common fixed contact and the selectable fixed contacts for guiding the moveable contact holder for the sliding movement of the moveable contacts.

In even higher frequency ranges, it is preferred to reduce the capacitance formed between the buffer electrodes and the other contacts. To accomplish this without impairing the smooth movement of the moveable contacts, each of the buffer electrodes may be divided into individually separated parts by at least one gap extending substantially in a same direction as the sliding movement of the moveable contacts.

In order to accomplish a smooth movement of the moveable contacts for a given size of gaps between each of the buffers and adjacent fixed contacts, the buffer electrodes may be separated from the common fixed contact and an associated one of the selectable fixed contacts by a gap having a substantially uniform width and extending obliquely with respect to the direction of the sliding movement of the moveable contacts. Preferably, each of the buffer electrodes is provided with the shape of a chevron having a convex side and a concave side facing the corresponding fixed contacts, the edge of the fixed contact opposing the convex side being provided with a complementary concave shape, the edge of the fixed contact opposing the concave side being provided with a complementary convex shape. By doing so, the moveable contacts are allowed to slide over the fixed contacts in a highly smooth fashion without dropping into the gaps defined between the fixed contacts.

The effect of the present invention can be further enhanced by equipping the switching device with the capability to switch over two signal lines at the same time by arranging two sets of the fixed contact sets and the moveable contacts one next to the other, and supporting the moveable contacts with a common moveable contact holder. In this case, in order to prevent cross-talks between the two lines, it is preferred to place a shield electrode connected to the ground electrode via a through hole passed through the dielectric layer in a gap defined between the common fixed contacts.

BRIEF DESCRIPTION OF THE DRAWINGS

Now the present invention is described in the following with reference to the appended drawings, in which.

DETAILED DESCRIPTION OF THE PREFERRED EMBODIMENTS

First Embodiment

Figure 1:
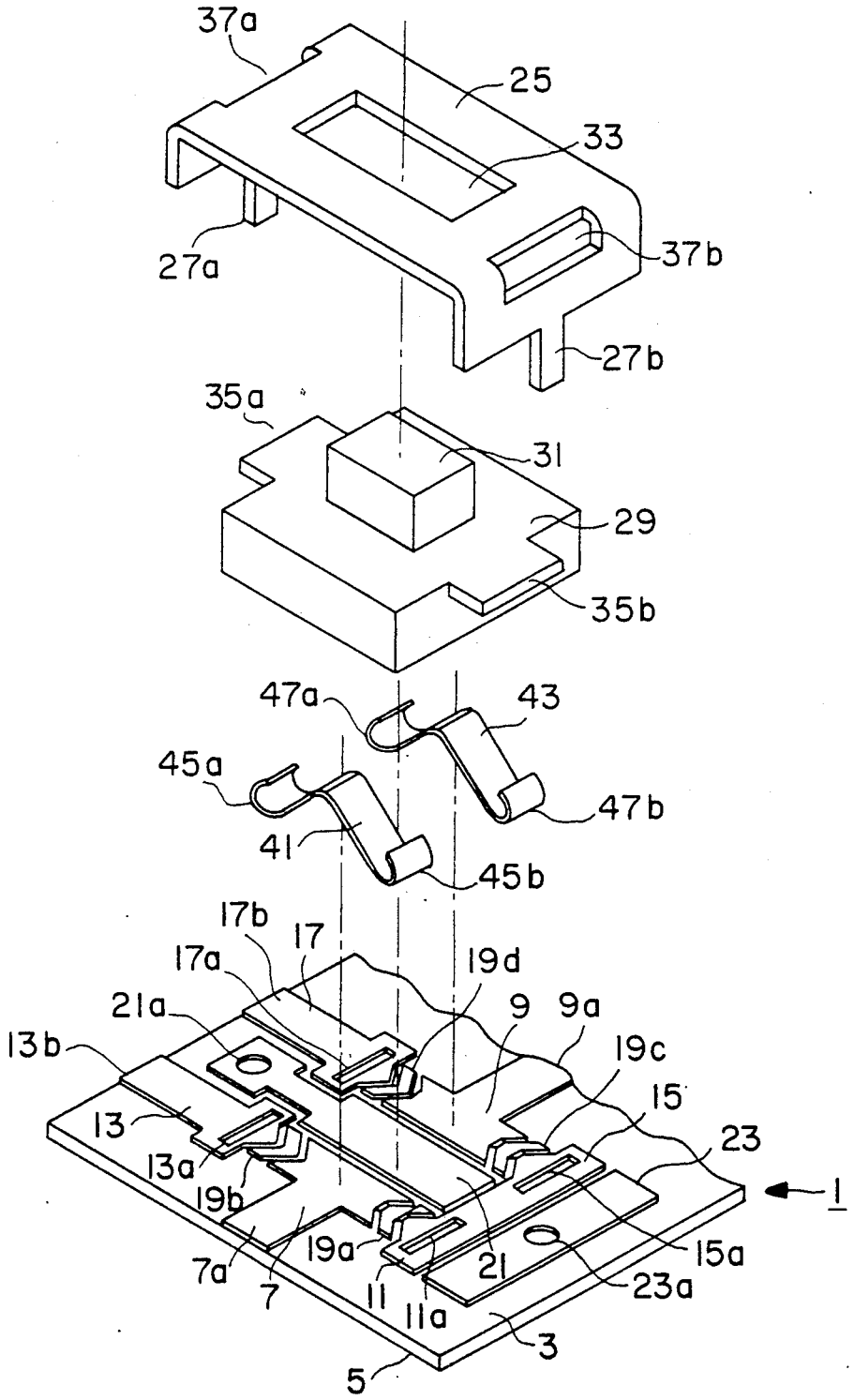
FIG. 1 is an exploded perspective view of a first embodiment of the super high frequency switching device according to the present invention.

Referring to FIG. 1, the switch base board 1 is provided with a planar dielectric layer 3, and a ground electrode 5 placed over the entire lower surface of the dielectric layer 3. The upper surface of the dielectric layer 3 is provided with a centrally located rectangular shield electrode 21, substantially T-shaped first and second common fixed contacts 7 and 9 arranged on either long side of the shield electrode 21, first through fourth selectable fixed contacts 11, 13, 15 and 17 arranged on either side of the fixed contacts 7 and 9, and buffer electrodes 19*a* through 19*d* arranged in the gaps between the first and second fixed contacts 7 and 9 and first through fourth selectable fixed contacts 11, 13, 15 and 17. The first through fourth selectable fixed contacts 11, 13, 15 and 17 are provided with rectangular recesses 11*a*, 13*a*, 15*a* and 17*a*, respectively. In the present embodiment, the selectable fixed contacts 11 and 15 are commonly connected. Another shield electrode 23 is formed along an edge of the commonly connected selectable fixed contacts 11 and 15 remote from the aforementioned shield electrode 21.

The first common fixed contact 7 is provided with an extension extending away from the shield electrode 21 to define an input terminal 7*a*, and the second common fixed contact 9 is provided with an extension extending away from the shield electrode 21 to define an output terminal 9*a*. The first selectable fixed contact 13 is likewise provided with an extension extending away from the first common fixed contact 7 to define another output terminal 13*b*, and the second selectable fixed contact 17 is provided with an extension extending away from the first common fixed contact 7 to define another input terminal 17*b*. The shield electrodes 21 and 23 are connected to the ground electrode 5 on the opposite side of the dielectric layer 3 via through hole 21*a* and 23*a*, respectively, passed through the dielectric layer 3. These through holes 21*a* and 23*a* also serve as mounting holes for a holder guide 25 as described hereinafter.

Each of the buffer electrodes 19*a* through 19*d* is chevron shaped with its convex side facing the corresponding common fixed contact 7 or 9, and its concave side facing the corresponding fixed selectable contact 11, 13, 15 or 17. These buffer contacts 19*a* through 19*d* are not connected to any other part. The opposing edges of the common fixed contacts 7 and 9 and the fixed selectable contacts 11, 13, 15 and 17 are either concave or convex in shape so as to define gaps of a substantially uniform width on either side of each of the buffer electrodes 19*a* through 19*d* in spite of the chevron shape of the buffer electrodes.

The first and second common fixed contacts 7 and 9 and the first through fourth selectable fixed contacts 11 through 17 form a micro strip in cooperation with the ground electrode 5 formed on the other side of the switch base board 1 opposite thereto, and a desired characteristic impedance can be obtained by appropriately selecting the thicknesses and widths of the first and second common fixed contacts 7 and 9 and the first through fourth selectable fixed contact 11 through 17, and the thickness of the dielectric layer 3. Electrostatic capacitance is formed between the buffer electrodes 19*a* through 19*d* and the first and second common fixed contacts 7 and 9 and between the first through fourth selectable fixed contact 11 through 17 and the buffer electrodes 19*a* through 19*d*. The buffer electrodes 19*a* through 19*d* themselves also form electrostatic capacitance in cooperation with the ground electrode 5 formed on the opposite side of the dielectric layer 3.

Figure 2:
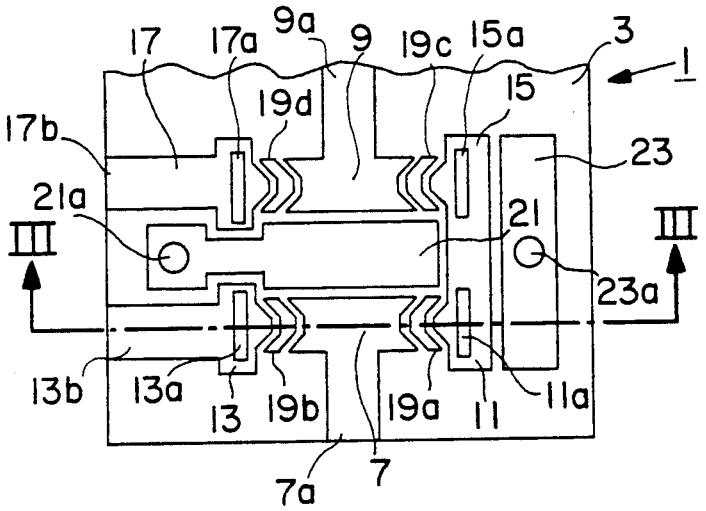
FIG. 2 is a plan view of the switch base board shown in FIG. 1.
Figure 3:
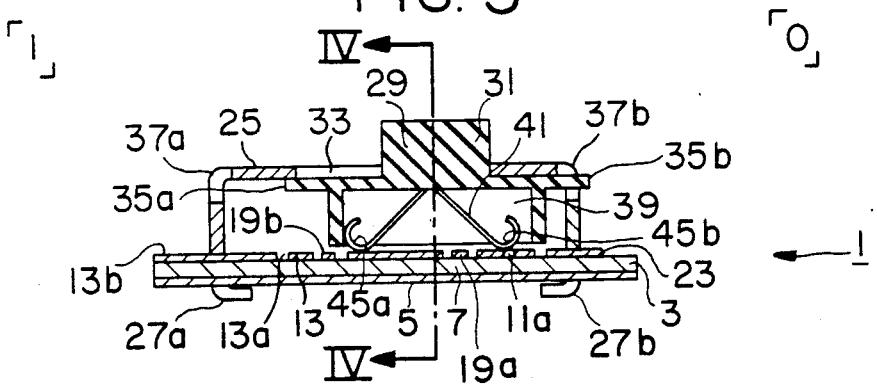
FIG. 3 is a sectional view taken along line III—III of FIG. 2 and line III'-III" of FIG. 4.
Figure 4:
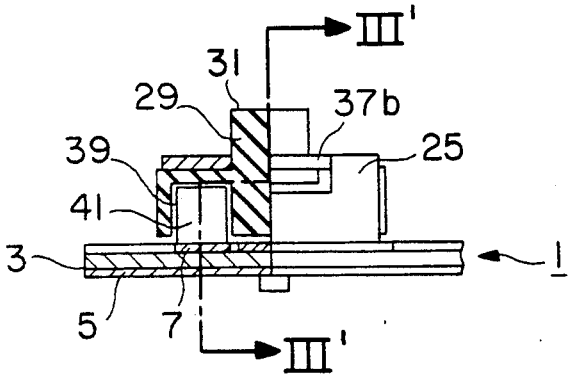
FIG. 4 is a sectional view taken along line IV—IV of FIG. 3.

A C-shaped holder guide 25 made of electroconductive plate is mounted on the switch base board 1 by inserting projections 27*a* and 27*b* formed at free ends of its two legs into corresponding mounting holes 21*a* and 23*a* in the switch base board 1 and bending them. The projections 27*a* and 27*b* are connected to the ground electrode 5, for instance by soldering. The holder guide 25 receives therein a spring holder 29 made of insulating material, such as synthetic resin. This spring holder 29 is provided with a pair of recesses 39 (only one of which is shown in FIG. 4) in its lower surface, a knob 31 projecting centrally from its upper surface, and a pair of lateral projections 35*a* and 35*b* which are slidably fitted into corresponding openings 37*a* and 37*b*, respectively, provided in base ends of the two legs of the holder guide 25. Thus, the spring holder 29 is retained in the holder guide 25 so as to be slidable along the lengthwise direction of the shield electrode 21. In FIG. 3, the cross section of the switch base plate 1 is taken along line III—III of FIG. 2, but the cross section of the holder guide 25 and the spring holder 29 are taken along line III'-III" of FIG. 4.

The recesses 39 of the spring holder 29 receive moveable contact springs 41 and 43 made of elastic copper alloy plate, such as phosphor copper plate, bent into the shape of letter W, respectively, as illustrated in FIGS. 1, 3 and 4. The moveable contact spring 41 is provided with a pair of rounded legs serving as moveable contacts 45*a* and 45*b* which resiliently slide over the common fixed contact 7 and the first fixed contact 11 or the second fixed contact 13 depending on the sliding position of the spring holder 29. Likewise, the moveable contact spring 43 is provided with a pair of rounded legs serving as moveable contacts 47*a* and 47*b* which resiliently slide over the common fixed contact 9 and the third fixed contact 15 or the fourth fixed contact 17 depending on the sliding position of the spring holder 29.

According to this super high frequency switching device, by holding the knob 31 of the spring holder 29 and sliding it in either direction, the moveable contacts 45*a*, 45*b*, 47*a* and 47*b* of the moveable contact springs 41 and 43 can take either a first condition in which the first and second common fixed terminals 7 and 9 are short-circuited by the selectable fixed contacts 11 and 15 or a second condition in which the first and second common fixed terminals 7 and 9 are individually connected to the third and fourth selectable fixed contacts 13 and 17, respectively.

In the first condition, a signal supplied from the input end 7*a* is outputted from the output terminal 9*a* via the moveable contact spring 41, the first and third selectable fixed contacts 11 and 15, the moveable contact spring 43 and the second common fixed contact 9. In the second condition, a signal supplied to the input terminal 7*a* is outputted from the output terminal 13*b* via the moveable contact spring 41 and the second selectable fixed contact 13 while an input signal supplied to the input terminal 17*b* is outputted from the output terminal 9*a* via the moveable contact spring 43 and the second common fixed contact 9.

When such a switch over is carried out by sliding the knob 31, the projections 35*a* and 35*b* of the spring holder 29 project from the corresponding openings 37*a* and 37*b* of the holder guide 25, respectively, and the upper surface of the spring holder 29 always keeps the opening 33 of the holder guide 25 closed with the help of the upper surfaces of the projections 35*a* and 35*b*.

Since the first and second common fixed contacts 7 and 9 and the first through fourth selectable fixed contacts 11 through 17 oppose the ground electrode 5 by way of the dielectric layer 3 so as to form a micro strip, it is possible to connect this switching device to an external circuit for instance having the characteristic impedance of 50 ohms at a favorable impedance matched condition by appropriately selecting the thicknesses and widths of the contacts. Furthermore, according to this embodiment, an electrostatic capacitance Cs is formed between the buffer electrodes 19*a* through 19*d* and the first and second common fixed contacts 7 and 9, and an electrostatic capacitance Cs is formed between the buffer electrodes 19*a* through 19*d* and the first through fourth selectable fixed contacts 11, 13, 15 and 17. The buffer electrodes 19*a* through 19*d* and the ground electrode 5 opposing them across the dielectric layer 3 form an electrostatic capacitance Cd.

Figure 5:
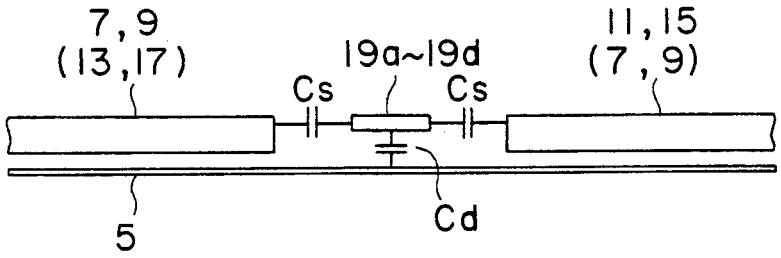
FIG. 5 is an equivalent circuit diagram for showing the operation of the super high speed switching device of FIG. 1.

The parts surrounding the buffer electrodes 19*a* through 19*d* can be expressed by the equivalent circuit given in FIG. 5, and signal leakage is divided and attenuated by the electrostatic capacitances Cs and Cd, and the additional electrostatic capacitance Cs sharply attenuates the signal leakage. Therefore, the presence of the electrostatic capacitance Cd is more effective than reducing the electrostatic capacitance Cs between the first and second common fixed contacts 7 and 9 and the first through fourth fixed contacts 11, 13, 15 and 17 by half or to Cs/2. In other words, the value of the electrostatic capacitance Cd varies depending on the surface area of the buffer electrodes 19*a* through 19*d* but can be easily made larger than Cs. By doing so, it is possible to reduce signal leakage by one third to by one fourth for each contact as compared to the case in which signal leakage is caused by the electrostatic capacitance Cs between the first and second common fixed contacts 7 and 9 and the first through fourth selectable fixed contacts 11, 13, 15 and 17.

Thus, according to the present invention, it is possible to reduce signal leakage, and offer a stable characteristic impedance over a wide frequency range including the GHz band.

Also, the moveable contact springs 41 and 43 typically include an inductance to a certain extent, and this may cause some difficulty in maintaining a stable characteristic impedance up to a sufficiently high frequency range for this reason. According to this embodiment, since the electroconductive holder guide 25 is connected to the ground electrode 5, the moveable contact springs 41 and 43 also function as an impedance line having a distributed capacitance by cooperation with the ground electrode 5, and the super high frequency switching device has a characteristic impedance as a whole so as to contribute to the improvement of its capability to handle super high frequency signals without involving any substantial signal attenuation.

Further, since the gaps between the buffer electrodes 19*a* through 19*d* and the first and second common fixed contacts 7 and 9 and between the buffer electrodes 19*a* through 19*d* and the first through fourth selectable fixed contacts 11 through 17 extend obliquely with respect to the direction in which the contact springs 41 and 43 are slid over the fixed contacts, the moveable contact springs 41 and 43 can move across the contacts without dropping the moveable contacts 45*a*, 45*b*, 47*a* and 47*b* into the gaps. When the moveable contact springs 41 and 43 are moved to each of the limits of their movement, the moveable contacts 45*a*, 45*b*, 47*a* and 47*b* are resiliently engaged by the corresponding recesses 11*a* through 17*a* provided in the selectable fixed contacts 11 through 17, and this not only stabilizes the selected position of the moveable contact springs but also produces a favorable feel for a person operating the spring holder 29.

The super high frequency switching device of the present invention has a favorable super high frequency property, and is simple in structure and compact in size. Furthermore, the moveable contact springs 41 and 43 would not be grounded when the moveable contact springs 41 and 43 are being actuated. The above described embodiment was capable of switching over two lines, but the present invention can also be applied to a switching device having the capability of switching only a single line by having only a half of the above described structure.

When a delay line involving a certain delay time is connected across the output terminal 13*b* and the input terminal 17*b*, a signal can be produced without involving any delay time by moving the knob 31 to the side of "0" in FIG. 3, and involving a certain delay by moving the knob 31 to the side of "1" in FIG. 3.

Therefore, a variable digital delay line can be constructed by connecting a plurality of delay line modules 49, 51, 53 and 55 each including one such super high frequency switching device SW1 through SW4 having two line switching capability and a delay line DL1 through DL4 each connected across the output terminal 13*a* and the input terminal 17*b* of the corresponding switching device. For instance, by selecting the delay times of the delay lines DL1 through DL4, as 100 ps, 200 ps, 400 ps and 800 ps, it is possible to obtain a delay time of zero to 1,500 ps by increments of 100 ps by operating the four super high frequency switching devices SW1 through SW4 accordingly. Since two switch contacts are connected in series for each of the switching devices in the above described digital variable delay line, signal leakage in each of the switching device can be reduced to one ninth to one sixteenth.

Figure 7:
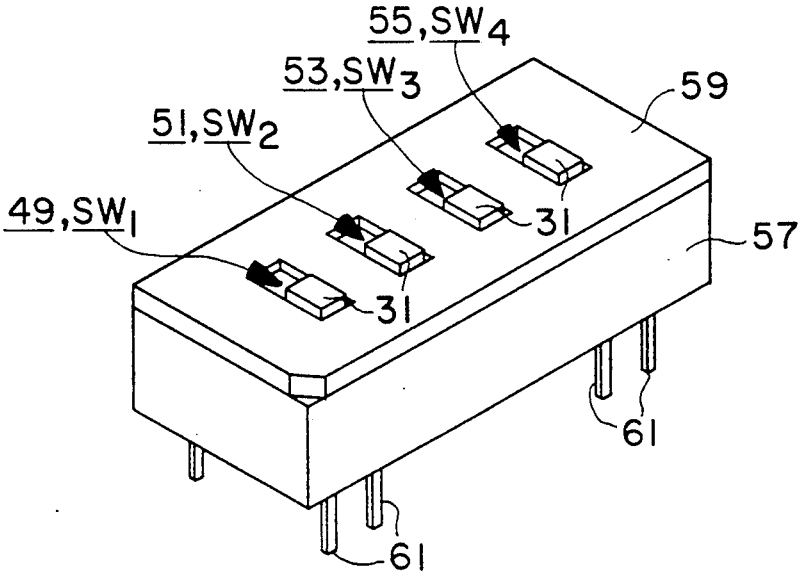
FIG. 7 is a perspective view of a switching device according to the present invention constructed for this application.

FIG. 7 is a perspective view of an embodiment in which a digital variable delay line including a plurality of such serially connected delay line modules is packaged in a casing 57. Numerals 59 and 61 denote a cover and terminal pins, respectively.

Figure 6:
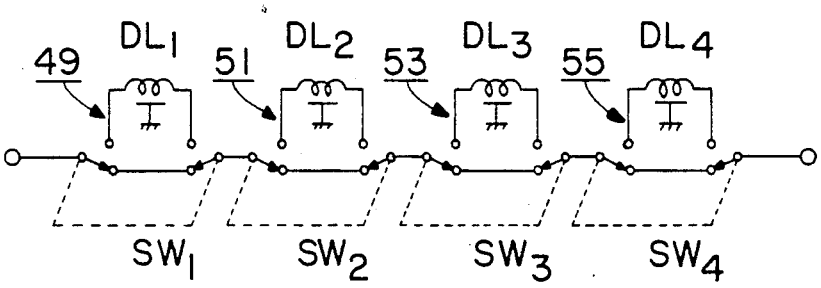
FIG. 6 is a circuit diagram showing an application of the present invention.

According to the experiment conducted by the inventor, it was found that a substantially flat delay property was obtained up to the 3 GHz band by using the four-bit digital delay line depicted in FIGS. 6 and 7.

Second Embodiment

Figure 8:
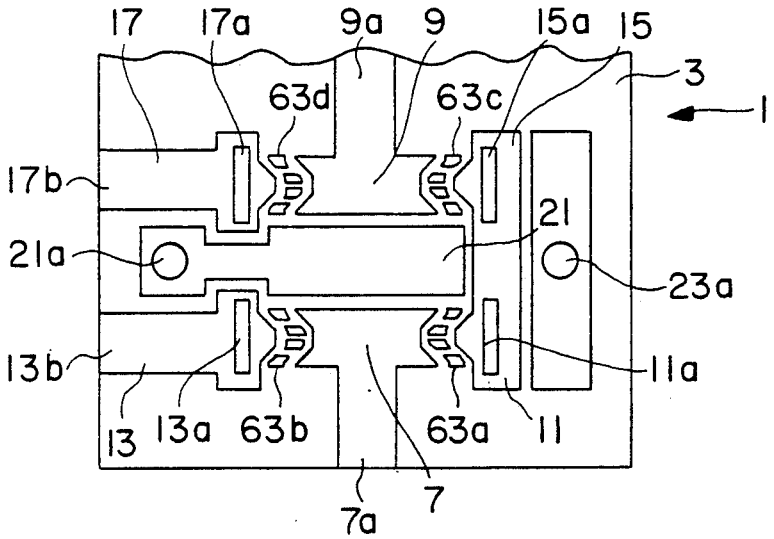
FIG. 8 is a fragmentary plan view of a second embodiment of the present invention.

FIG. 8 shows a second embodiment of the present invention. In this embodiment, each of the buffer electrodes 63*a* through 63*d* are divided into a plurality of mutually separated sections by gaps extending in the direction of the movement of the moveable contact springs 41 and 43. Otherwise, this embodiment is similar to the preceding embodiment. The first embodiment was suitable for switching over super high frequency signals as it involves very little signal leakage due to the electrostatic capacitance Cs, but the presence of the electrostatic capacitance Cs still is not desirable as the frequency of the signal is raised even higher. By dividing the buffer electrodes into a plurality of sections, the electrostatic capacitances Cs and Cd are reduced, and the switching device can be used for signals of even higher frequencies. The gaps defining a plurality of sections in each of the buffer electrodes would not affect the sliding movement of the moveable contact springs as they extend in the same direction as the movement of the moveable contact springs 41 and 43.

Figure 9:
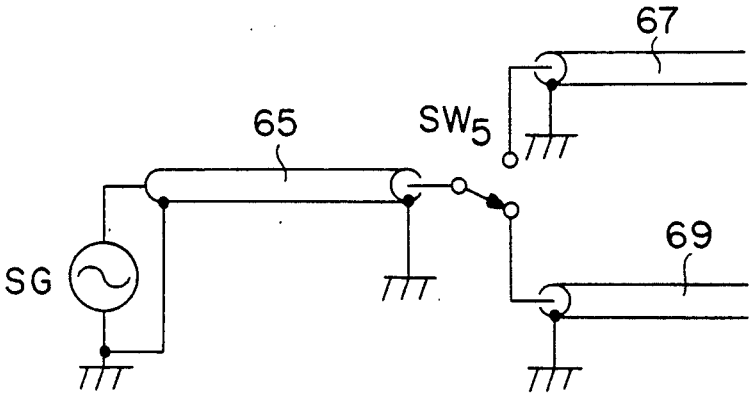
FIG. 9 is a circuit diagram showing another application of the present invention.

Although a digital variable delay line was given above as an application of the present invention, the present invention can also be applied to other applications. For instance, it may be used as a normal super high frequency switch SW5 for switching over a signal line 65 connected to a signal source SG between a first output signal line 67 and a second output signal line 69 as illustrated in FIG. 9.

Although the present invention has been described in terms of specific embodiments, it is possible to modify and alter details thereof without departing from the spirit of the present invention. For instance, the super high frequency switching device of the present invention may be formed not only on a special dielectric layer but also on a printed circuit board for carrying IC devices and other electronic component parts.

What we claim is:

1. A super high frequency switching device, comprising:

a dielectric layer having first and second major surfaces opposing each other;

a ground electrode formed on said first major surface;

a common fixed contact formed on said second major surface and opposed to said ground electrode;

a pair of selectable fixed contacts formed on said second major surface on either side of said common fixed contact, and opposed to said ground electrode;

a pair of buffer electrodes formed in gaps defined between said common fixed contact and said selectable fixed contacts, and opposed to said ground electrode;

an insulated moveable contact holder slidably supported in a holder guide mounted in said dielectric layer and covering said common fixed contact, said pair of selectable fixed contacts and said pair of buffer electrodes; and moveable contacts carried by said moveable contact holder for sliding contact with said common fixed contact and said selectable fixed contacts between a first position to electrically connect said common fixed contact with one of said selectable fixed contacts and a second position to electrically connect said common fixed contact with the other of said selectable fixed contacts.

2. A super high frequency switching device according to claim 1, further comprising an electroconductive holder guide electrically connected to said ground terminal and placed above said common fixed contact and said selectable fixed contacts for guiding said moveable contact holder for the sliding movement of said moveable contacts.

3. A super high frequency switching device according to claim 1, wherein each of said buffer electrodes is divided into individually separated parts by at least one gap extending substantially in a same direction as the sliding movement of said moveable contacts.

4. A super high frequency switching device according to claim 1, wherein each of said buffer electrodes is divided from said common fixed contact and associated one of said selectable fixed contacts by a gap having a substantially uniform width and extending obliquely with respect to the direction of the sliding movement of said moveable contacts.

5. A super high frequency switching device according to claim 1, wherein each of said buffer electrodes is provided with the shape of a chevron having a convex side and a concave side facing the corresponding fixed contacts, the edge of the fixed contact opposing said convex side being provided with a complementary concave shape, the edge of the fixed contact opposing said concave side being provided with a complementary convex shape.

6. A super high-frequency switching device, comprising:

a dielectric layer having first and second major surfaces opposing each other;

a ground electrode formed on said first major surface;

a pair of common fixed contacts formed on said second major surface and opposed to said ground electrode;

a pair of selectable fixed contacts formed on said second major surface on either side of said common fixed contact and opposed to said ground electrode;

a pair of buffer electrodes formed in gaps defined between each of said common fixed contact and associated ones of said selectable fixed contacts and opposed to said ground electrode;

an insulated moveable contact holder slidably supported in a holder guide mounted in said dielectric layer and covering said common fixed contact, said pair of selectable fixed contacts and said pair of buffer electrodes; and two pairs of moveable contacts carried by said moveable contact holder for sliding contact with said common fixed contacts and said selectable fixed contacts between a first position to electrically connect each of said common fixed contacts with one of the associated selectable fixed contacts and a second position to electrically connect said common fixed contact with the other of the associated selectable fixed contacts;

two of said selectable fixed contacts disposed on one side of said common fixed contacts being combined into a commonly connected selectable fixed contact.

7. A super high frequency switching device according to claim 6, wherein a shield electrode connected to said ground electrode via a through hole passed through said dielectric layer is placed in a gap defined between said common fixed contacts.

* * * * *